US010132548B2

(12) United States Patent
Cur et al.

(10) Patent No.: US 10,132,548 B2
(45) **Date of Patent: *Nov. 20, 2018**

(54) SECONDARY COOLING PATH IN REFRIGERATOR

(71) Applicant: Whirlpool Corporation, Benton Harbor, MI (US)

(72) Inventors: Nihat O. Cur, Plymouth, MN (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/331,088

(22) Filed: Oct. 21, 2016

(65) Prior Publication Data

US 2017/0038120 A1 Feb. 9, 2017

Related U.S. Application Data

(60) Continuation of application No. 15/017,207, filed on Feb. 5, 2016, now Pat. No. 9,500,401, which is a (Continued)

(51) Int. Cl.

| | |
|---|---|
| ***F25B 45/00*** | (2006.01) |
| ***F25D 11/02*** | (2006.01) |
| ***F25D 23/02*** | (2006.01) |
| ***F25C 5/185*** | (2018.01) |
| ***F25D 17/02*** | (2006.01) |
| ***F25D 21/06*** | (2006.01) |
| ***F25C 5/182*** | (2018.01) |
| ***F25D 21/12*** | (2006.01) |

(52) U.S. Cl.

CPC ..... *F25D 11/025* (2013.01); *F25C 5/182* (2013.01); *F25C 5/185* (2013.01); *F25D 17/02* (2013.01); *F25D 21/06* (2013.01); *F25D 21/12* (2013.01); *F25D 23/028* (2013.01); *F25B 45/00* (2013.01); *F25B 2500/06* (2013.01); *F25C 2400/10* (2013.01)

(58) Field of Classification Search

CPC ..... F25C 2400/10; F25B 45/00
USPC ..... 62/149
See application file for complete search history.

(56) References Cited

U.S. PATENT DOCUMENTS 2,028,046 A 1/1936 Calatroni
2,514,301 A 7/1950 Tenney
(Continued)

*Primary Examiner* — Daniel C Comings
(74) *Attorney, Agent, or Firm* — Nyemaster Goode, P.C.

(57) ABSTRACT

A refrigerator includes a secondary cooling path for circulating liquid coolant through the refrigerator wherein the liquid coolant is cooled by the freezer compartment and wherein the liquid coolant cools the ice maker and the ice bin as the liquid coolant circulates through the secondary cooling path. A pump is positioned along the secondary cooling path for pumping the liquid coolant through the secondary cooling path. A tube having a first end proximate the pump and an opposite end exposed to atmosphere may control suction pressure associated with the pump. The refrigerator reduces frost build up through configuration of the secondary cooling path or performing ice harvesting operations which melt frost. The secondary cooling path may be used to provide for circulating hot liquid. The secondary cooling path may be used to provide for circulating liquid coolant during a power outage.

20 Claims, 6 Drawing Sheets

Related U.S. Application Data continuation of application No. 13/732,478, filed on Jan. 2, 2013, now Pat. No. 9,291,384, which is a division of application No. 12/105,618, filed on Apr. 18, 2008, now Pat. No. 8,359,874.

(56) References Cited

U.S. PATENT DOCUMENTS

| | | | |
|---|---|---|---|
| 3,667,249 | A | 6/1972 | Brown et al. |
| 3,745,786 | A | 7/1973 | Laughlin et al. |
| 3,945,217 | A | 3/1976 | Bashark |
| 4,003,214 | A | 1/1977 | Schumacher |
| 4,006,601 | A | 2/1977 | Ballarin et al. |
| 4,075,866 | A | 2/1978 | Williamitis |
| 4,187,690 | A | 2/1980 | Lindahl |
| 4,192,149 | A | 3/1980 | Webb |
| 4,420,943 | A | 12/1983 | Clawson |
| 4,442,681 | A | 4/1984 | Fischer |
| 4,481,787 | A | 11/1984 | Lynch |
| 4,722,200 | A | 2/1988 | Frohbieter |
| 4,979,377 | A | 12/1990 | Fievet et al. |
| 5,209,073 | A | 5/1993 | Thomas et al. |
| 5,218,830 | A | 6/1993 | Martineau |
| 5,377,498 | A | 1/1995 | Cur et al. |
| 5,396,777 | A | 3/1995 | Martin |
| 5,669,222 | A | 9/1997 | Jaster et al. |
| 5,941,085 | A | 8/1999 | Jeon |
| 6,148,634 | A | 11/2000 | Sherwood |
| 6,171,073 | B1 | 1/2001 | McKain et al. |
| 6,196,007 | B1 | 3/2001 | Schlosser et al. |
| 6,266,966 | B1 | 7/2001 | Fernandez et al. |
| 6,286,322 | B1 | 9/2001 | Vogel et al. |
| 6,526,767 | B1 | 3/2003 | Lopes |
| 6,715,305 | B2 | 4/2004 | Doi et al. |
| 6,775,998 | B2 | 8/2004 | Yuasa et al. |
| 6,990,819 | B2 | 1/2006 | Darling |
| 7,000,414 | B2 | 2/2006 | Lee et al. |
| 7,065,982 | B2 | 6/2006 | Schmid et al. |
| 7,137,262 | B2 | 11/2006 | Carter |
| 7,137,266 | B2 | 11/2006 | Kim et al. |
| 7,228,703 | B2 | 6/2007 | Kim et al. |
| 7,437,885 | B2 | 10/2008 | Wu et al. |
| 7,610,773 | B2 | 11/2009 | Rafalovich et al. |
| 8,408,023 | B2 | 4/2013 | Shin et al. |
| 9,500,401 | B2 * | 11/2016 | Cur ..... F25D 11/025 62/71 |
| 2004/0050083 | A1 | 3/2004 | Yuasa et al. |
| 2005/0000238 | A1 | 1/2005 | Schmid et al. |
| 2005/0061009 | A1 | 3/2005 | Flinner et al. |
| 2005/0081548 | A1 | 4/2005 | Lee et al. |
| 2006/0179858 | A1 | 8/2006 | Yoshioka et al. |
| 2006/0225457 | A1 | 10/2006 | Hallin |
| 2006/0276938 | A1 | 12/2006 | Miller |
| 2007/0119193 | A1 | 5/2007 | Davis et al. |
| 2008/0141699 | A1 | 6/2008 | Rafalovich et al. |

* cited by examiner

SECONDARY COOLING PATH IN REFRIGERATOR

CROSS-REFERENCE TO RELATED APPLICATIONS

This application is a continuation of and claims priority to U.S. patent application Ser. No. 15/017,207, entitled "SECONDARY COOLING PATH IN A REFRIGERATOR," which was filed on Feb. 5, 2016, which is pending. U.S. patent application Ser. No. 15/017,207 is a continuation of and claims priority to U.S. patent application Ser. No. 13/732,478 entitled "SECONDARY COOLING PATH IN A REFRIGERATOR" filed Jan. 2, 2013, now U.S. Pat. No. 9,291,384. U.S. patent application Ser. No. 13/732,478 is a divisional of and claims priority to U.S. patent application Ser. No. 12/105,618 entitled "SECONDARY COOLING PATH IN A REFRIGERATOR" filed Apr. 18, 2008, now U.S. Pat. No. 8,359,874. The entire disclosure of each of the above documents is hereby incorporated by reference.

FIELD OF THE INVENTION

The present invention relates to the field of refrigeration. More specifically, the present invention provides a secondary cooling path or loop for cooling an ice maker which is remote from a freezer compartment.

BACKGROUND

Refrigerators typically have a fresh food compartment and a freezer compartment. In addition refrigerators may have ice and water features to provide for chilling and dispensing water and making and dispensing ice. The addition of ice and water features presents various problems in different contexts.

For example, one problem is associated with adding ice and water features to a bottom mount refrigerator. In a bottom mount refrigerator, the freezer compartment is positioned below the fresh food compartment. There is a limited amount of useable space in the fresh food compartment and adding ice and water features may reduce the space in the fresh food compartment. One approach to addressing such a problem is to create an in-the-door ice maker/storage system where the cold air is drawn from the freezer compartment. However, there are problems with such an approach. One problem is that cold air stream-based solutions may not provide enough cooling capacity to refrigerator features, whether within the refrigerator or on the door, thus limiting their capacity and performance. Another problem is that air duct gaskets may be required and air leaks may be experienced.

An alternative approach is to provide for secondary cooling within the refrigerator or on the door of the refrigerator. A secondary coolant loop may be used to bring to cold from the freezer compartment to the in-the-door ice maker/storage system. The idea eliminates the potential problems associated with air duct gaskets and air leaks. Yet problems remain with such an approach. In particular, there is the possibility of frost buildup inside the ice maker and ice storage assemblies when the ice maker is not in the freezer compartment, but elsewhere in the refrigerator.

SUMMARY

Therefore, it is a primary object, feature, or advantage of the present invention to improve over the state of the art.

It is a further object, feature, or advantage of the present invention to provide for using a secondary coolant loop in a manner that assists in preventing frost build up.

It is a still further object, feature, or advantage of the present invention to allow for in-door ice making, storage, and dispensing.

Another further object, feature, or advantage of the present invention is to allow for more usable space in the fresh food compartment.

Yet another object, feature, or advantage of the present invention is to allow for extending cold during a power outage.

According to one aspect of the present invention, a refrigerator includes a refrigerator cabinet having a fresh food compartment and a freezer compartment, the freezer compartment mounted below the fresh food compartment. The refrigerator further includes a first fresh food compartment door for providing access to the fresh food compartment and an ice compartment mounted at the first fresh food compartment door, the ice compartment having an ice maker and an ice bin. The refrigerator further includes a secondary cooling path for circulating liquid coolant through the refrigerator wherein the liquid coolant is cooled by the freezer compartment and wherein the liquid coolant cools the ice maker and the ice bin as the liquid coolant circulates through the secondary cooling path. A pump is positioned along the secondary cooling path for pumping the liquid coolant through the secondary cooling path. There is a tube having a first end proximate the pump and an opposite end exposed to atmosphere to thereby control suction pressure associated with the pump.

According to another aspect of the present invention, a refrigerator includes a refrigerator cabinet having a fresh food compartment and a freezer compartment, the freezer compartment mounted below the fresh food compartment. There is a first fresh food compartment door for providing access to the fresh food compartment and an ice compartment mounted at the first fresh food compartment door, the ice compartment including an ice maker and an ice bin. There is a secondary cooling path for circulating liquid coolant through the refrigerator wherein the liquid coolant is cooled by the freezer compartment and wherein the liquid coolant cools the ice maker and the ice bin as the liquid coolant circulates through the secondary cooling path. A pump is positioned along the secondary cooling path for pumping the liquid coolant through the secondary cooling path. The secondary cooling path is configured to provide for cooling the ice maker to a lower temperature than the ice bin to thereby attract moisture to the ice maker.

According to another aspect of the present invention a refrigerator includes a refrigerator cabinet having a fresh food compartment and a freezer compartment, the freezer compartment mounted below the fresh food compartment. There is a first fresh food compartment door for providing access to the fresh food compartment. There is also an ice compartment mounted at the first fresh food compartment door, the ice compartment having an ice maker and an ice bin. There is also a secondary cooling path for circulating liquid coolant through the refrigerator wherein the liquid coolant is cooled by the freezer compartment and wherein the liquid coolant cools the ice maker and the ice bin as the liquid coolant circulates through the secondary cooling path. A pump is positioned along the secondary cooling path for pumping the liquid coolant through the secondary cooling path. There is also a primary cooling path for circulating cold air wherein the primary cooling path circulates cold air from the freezer compartment to the ice maker compartment and from the ice maker compartment to the fresh food compartment to thereby reduce frost buildup inside the ice maker compartment.

According to another aspect of the present invention, a refrigerator includes a refrigerator cabinet having a fresh food compartment and a freezer compartment, the freezer compartment mounted below the fresh food compartment, a first fresh food compartment door for providing access to the fresh food compartment, and an ice compartment mounted at the first fresh food compartment door, the ice compartment comprising an ice maker and an ice bin. There is a secondary cooling path for circulating liquid coolant through the refrigerator wherein the liquid coolant is cooled by the freezer compartment and wherein the liquid coolant cools the ice maker and the ice bin as the liquid coolant circulates through the secondary cooling path. A pump is positioned along the secondary cooling path for pumping the liquid coolant through the secondary cooling path. There is also a valve in fluid connection with the pump wherein the valve provides for switching between circulating liquid coolant through the secondary cooling path and circulating a hot liquid through the secondary cooling path.

According to another aspect of the present invention, a method is provided for reducing frost build up in a refrigerator having a refrigerator cabinet with a fresh food compartment and a freezer compartment, the freezer compartment mounted below the fresh food compartment, a first fresh food compartment door for providing access to the fresh food compartment, and an ice compartment mounted at the first fresh food compartment door, the ice compartment comprising an ice maker and an ice bin. The method includes circulating liquid coolant in a secondary cooling path to provide for the liquid coolant being cooled by the freezer compartment and cooling the ice compartment and reducing moisture at the ice maker to thereby reduce frost build up. The reducing moisture step may be performed by configuring the secondary cooling path to provide for the ice maker being at a lower temperature than the ice bin to attract moisture and reducing the moisture by performing an ice harvest operation. The reducing moisture step may be performed by circulating cold air from the freezer compartment through the ice compartment prior to the fresh food compartment to thereby absorb moisture from the ice compartment.

DETAILED DESCRIPTION

Figure 1:
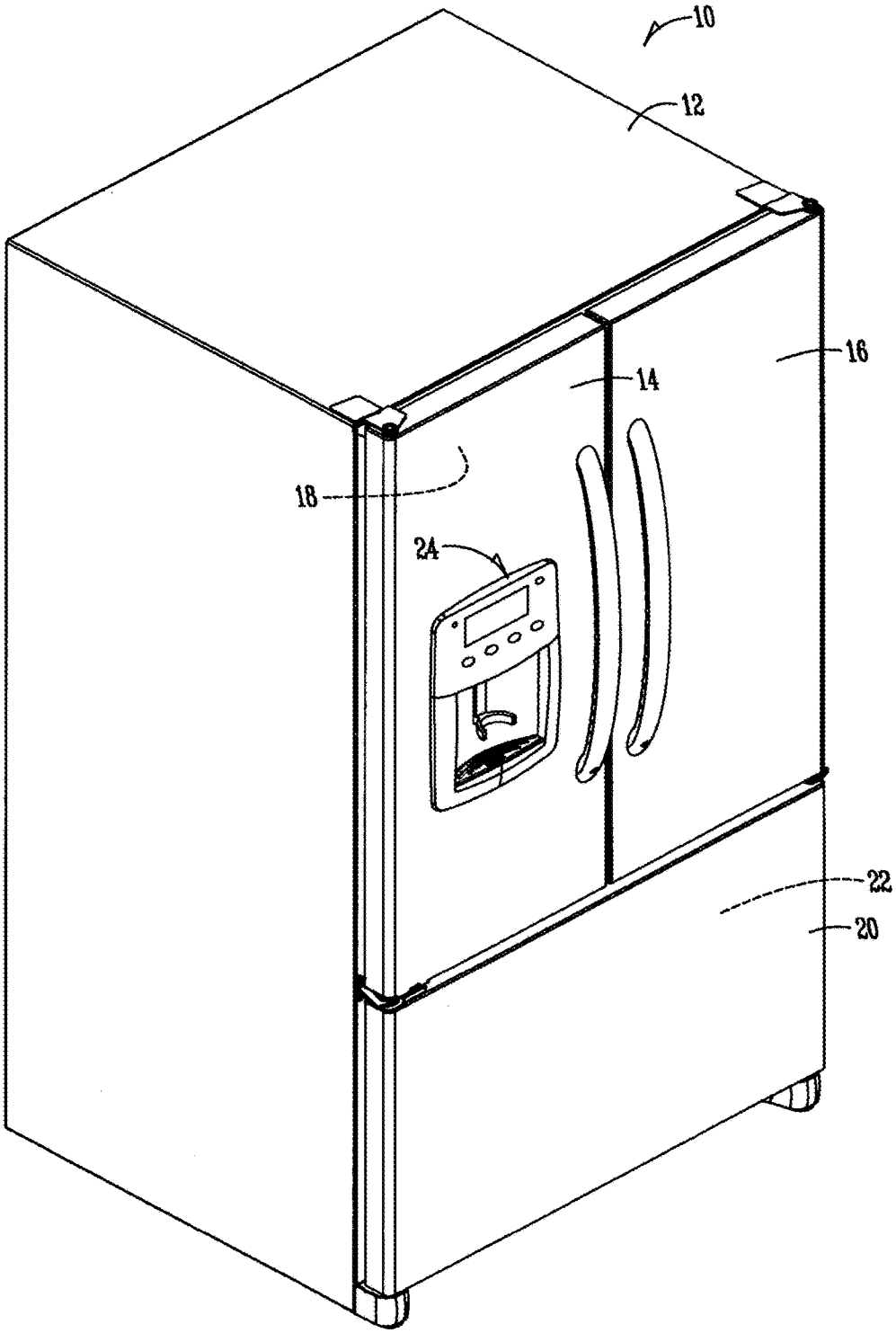
FIG. 1 is a perspective view of one embodiment of a bottom mount refrigerator according to one aspect of the present invention.

FIG. 1 illustrates one embodiment of a refrigerator 10. The refrigerator 10 includes a refrigerator housing or cabinet 12. A first fresh food compartment door 14 and a second fresh food compartment door 16 provide access to a fresh food compartment 18. A freezer door 20 provides access to the freezer compartment 22. The refrigerator 10 is shown in a bottom mount configuration in that the freezer compartment 20 is positioned below the fresh food compartment 18. An ice and water dispenser 24 is positioned on the first fresh food compartment door 14. Note that the ice and water dispenser 24 is positioned remotely from the freezer compartment 20.

Figure 2:
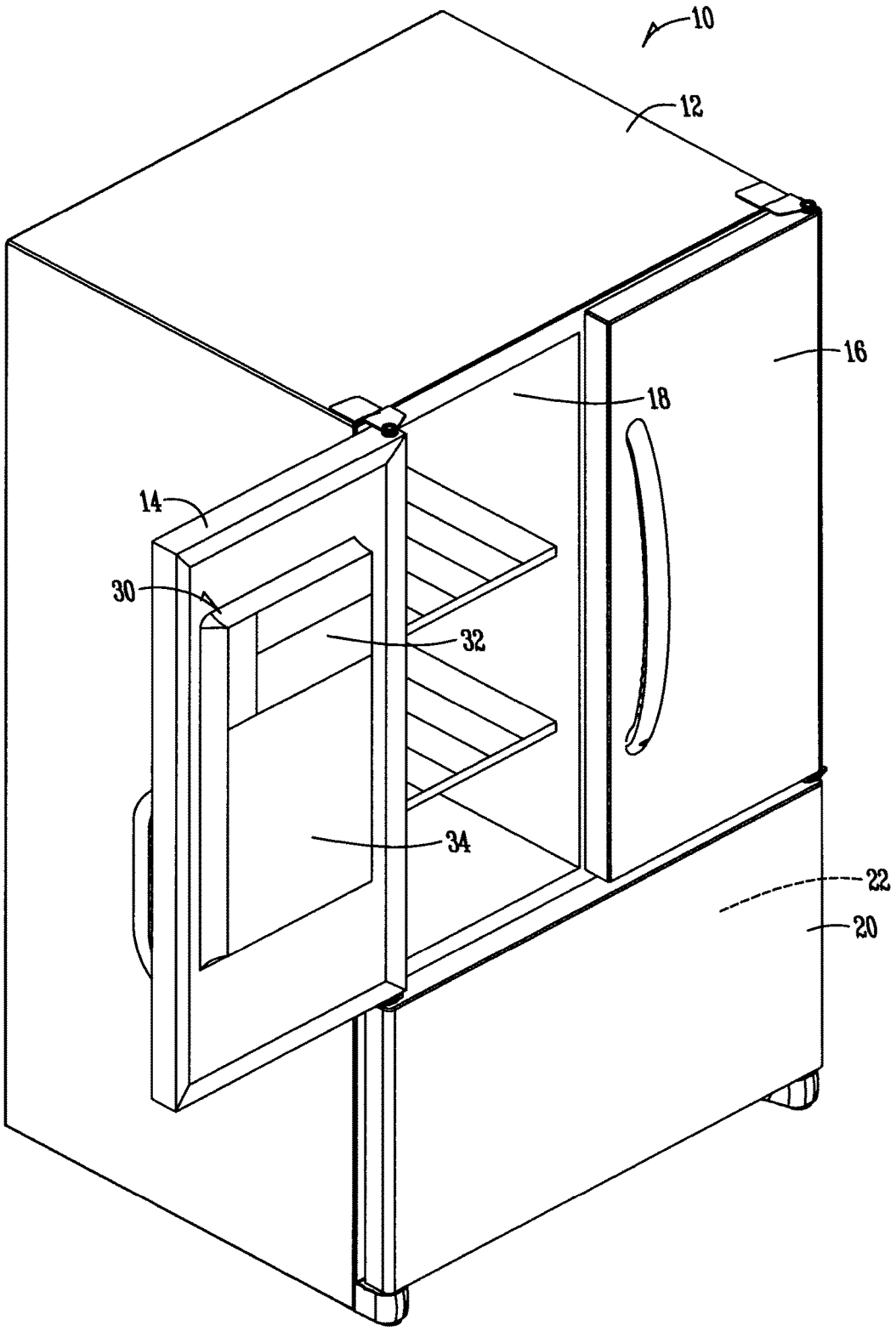
FIG. 2 is a view of the refrigerator of FIG. 1 with the first fresh food compartment door open and showing an ice compartment positioned at the door.

FIG. 2 illustrates the refrigerator 10 of FIG. 1 with the first fresh food compartment door 14 in an open position. An ice compartment 30 is shown positioned at the first refrigeration compartment door 14. The ice compartment 30 includes a direct contact ice maker 32 and an ice storage area or ice bin 34.

Figure 3:
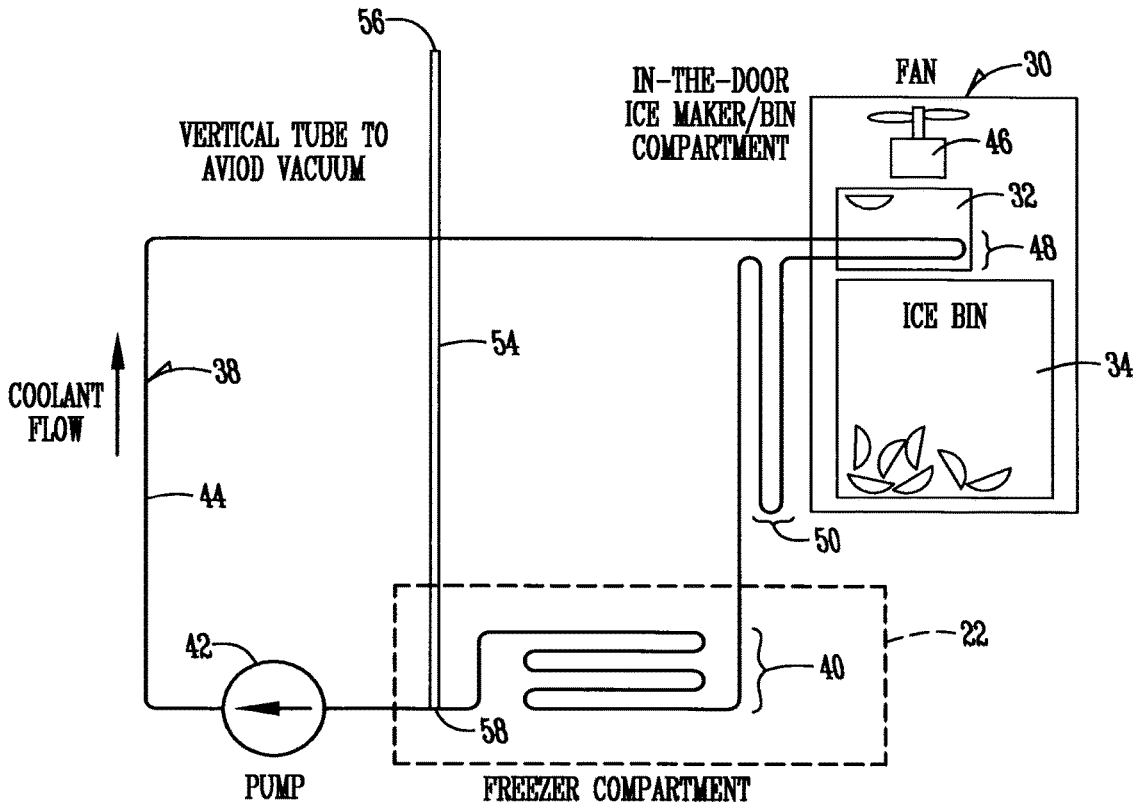
FIG. 3 is a diagram of the refrigerator of FIG. 1 showing a secondary cooling path where a liquid coolant is used.

FIG. 3 is a diagram illustrating a secondary cooling path 38. The freezer compartment 22 is shown which provides for cooling coolant within the secondary cooling path 38. The secondary cooling path 38 extends from a pump 42 along a coolant line 44 through the ice maker 32, forming one or more loops 48 proximate the ice maker and forming one or more loops 50 proximate the ice bin and back to the freezer compartment where a heat exchanger 40 formed from one or more loops is provided. Also shown in FIG. 3 is a fan 46 associated with the ice compartment 30. There is also a tube 54 with a top end 56 and a bottom end 58. The top end 56 of the tube 54 is exposed to the atmosphere while the bottom end is in the freezer compartment 22. In order to avoid vacuum in the suction side of the pump 42, the tube 54 which may be a small vertical tube is provided before the pump 42. This results in the system having one atmospheric pressure at the suction pressure.

The ice maker 32 shown in FIG. 3 may also be used as a defrost device. The secondary cooling path 38 may provide for circulation in a manner that results in the ice maker 32 being the coldest place in the ice compartment 30 and thereby attracts moisture to its body. During an ice harvesting operation, frost which may have accumulated on the ice compartment 30 due to the moisture will melt due to the intense heat that is used in the ice harvesting process. Therefore, the ice maker 32 becomes a defrost device. To maintain the ice storage area or ice bin 34 below freezing, a small fan 46 may be used to circulate small amounts of cold air from the ice maker 32 into the ice bin 34 keeping the ice bin 34 both cold and dry.

Figure 4:
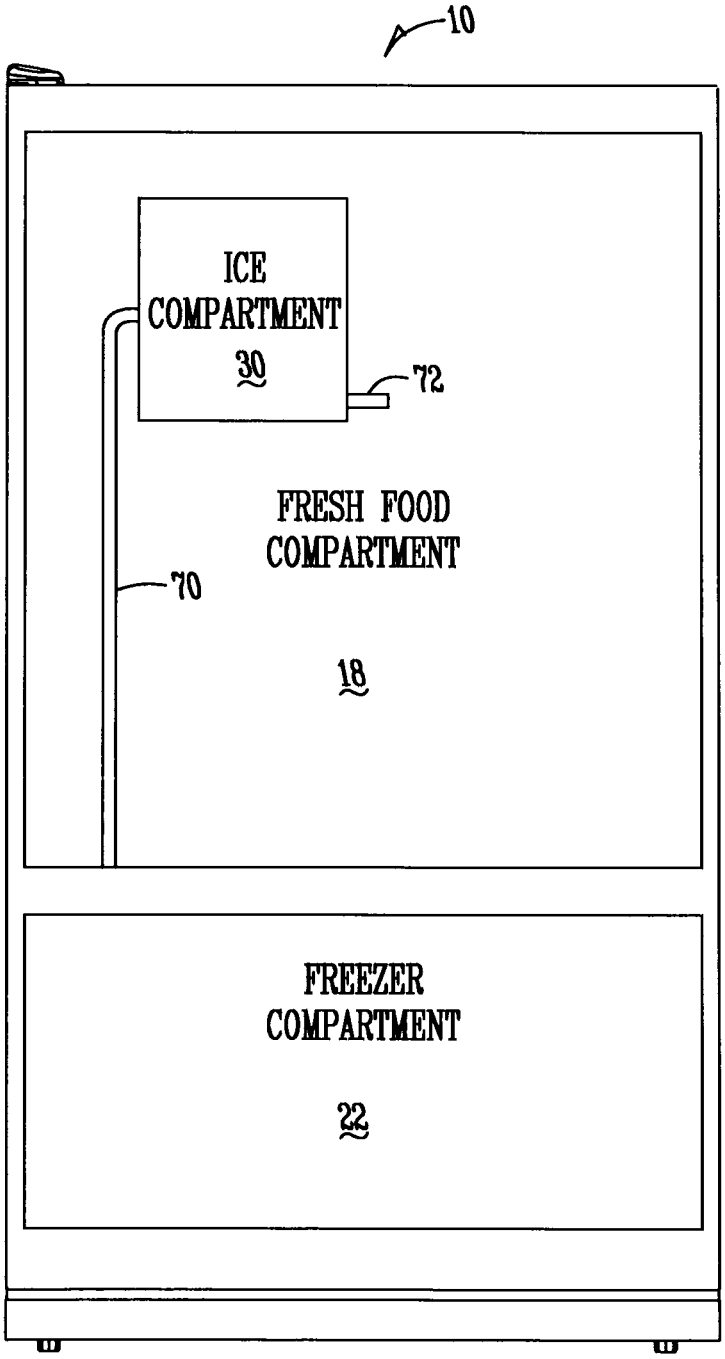
FIG. 4 is diagram showing air flow from the freezer compartment through the ice compartment and to the fresh food compartment.

FIG. 4 illustrates another configuration for reducing frost buildup. In FIG. 4, a refrigerator 10 has a fresh food compartment 18 positioned above a freezer compartment 22. An ice compartment 30 is positioned remotely from the freezer compartment such as at a door providing access to the fresh food compartment 18. There are one or more air ducts 70 which bring cold air from the freezer compartment to the ice compartment 30. After cooling in the ice compartment 30, this air may leave the ice compartment such as through an opening or outlet port 72. Thus cold air from the freezer compartment 22 is routed to the ice compartment 30 first so as to keep the ice compartment 30 cold and dry. This cold air is not necessary for making ice as a direct contact ice maker is used as previously explained. The cold air from the freezer compartment 30 has an extremely low absolute humidity and therefore is able to absorb moisture from the ice compartment 30 before going back into the fresh food compartment 18 and eventually returning to the freezer compartment 22.

Figure 5:
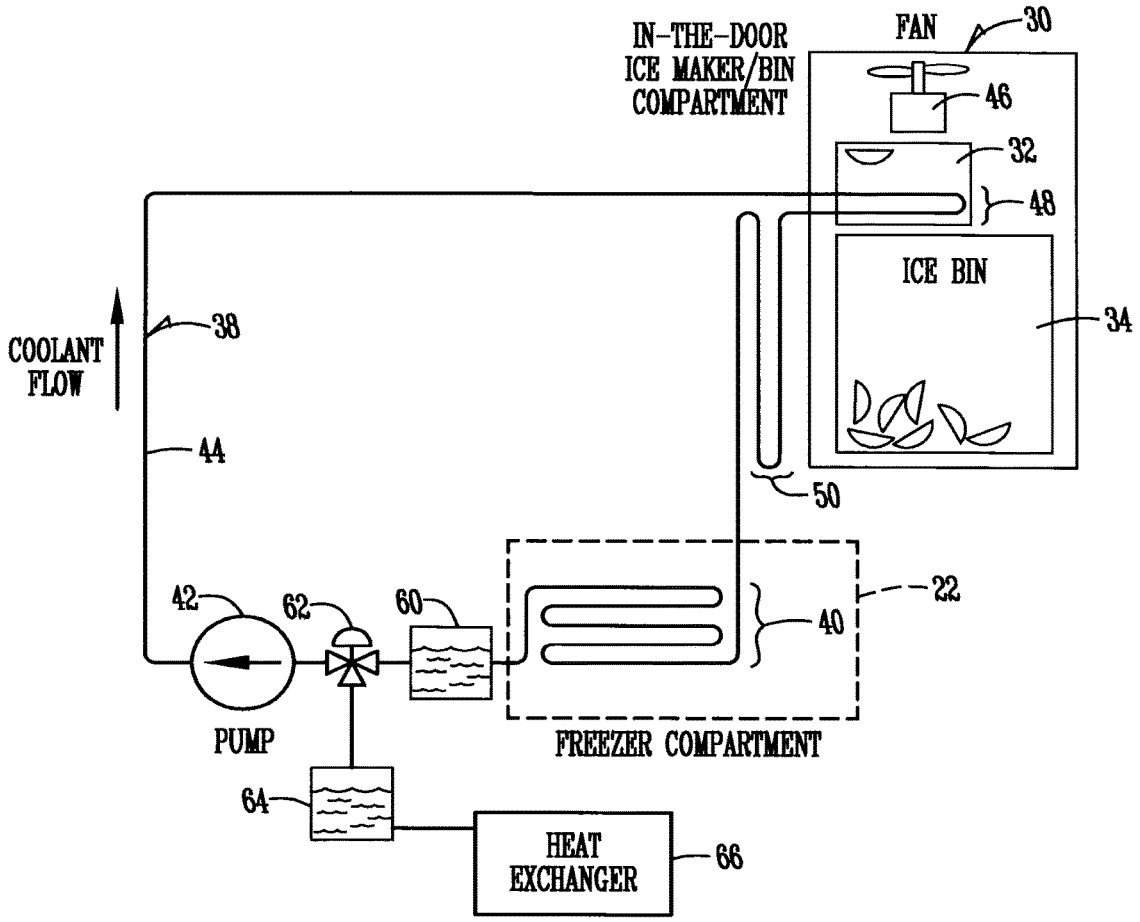
FIG. 5 is a diagram of the refrigerator of FIG. 1 showing a secondary cooling path where either a liquid coolant or a hot liquid may be used.

When a secondary cooling path is used with a coolant, a hot liquid defrost system may also be implemented. As shown in FIG. 5, a three-way valve 62 may be used to switch between coolant and a hot liquid. A coolant container 60 is shown as well as a hot liquid container 64 which may be heated with a heat exchanger 66. During "hot" operation, the liquid is heated in a heat exchanger 66 that may be placed outside the refrigerator. The heat source can be the heat rejected from the condenser of the refrigerator or simply an electric heater. The hot liquid may be circulated to the ice compartment 30 for hot liquid ice harvesting thereby providing a low voltage approach to having an ice compartment in the door.

Figure 6:
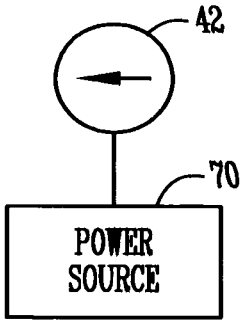
FIG. 6 is a diagram showing a power source electrically connected to a pump for operating the pump during a power outage.

Another advantage that can be realized from the secondary cooling path relates to extended cold operation of the refrigerator. As shown in FIG. 6, when a power outage is experienced, a battery or other stand by power source 70 may drive the pump 42 to thereby provide for cooling of the ice compartment 30 and the fresh food compartment 18.

The description of the disclosure is merely exemplary in nature and, thus, contemplates numerous variations, options, and alternatives. For example, variations in the configuration of the refrigerator, variations in the type of liquid coolant, variations in the secondary cooling path, variations in the manner in which frost buildup is reduced, variations in the type of stand-by power source where used, and other variations, options and alternatives are within the spirit and scope of the invention.

What is claimed is:

1. A refrigerator comprising:

a fresh food compartment and a freezer compartment;

a fresh food compartment door for providing access to the fresh food compartment;

a compartment positioned remotely from the freezer compartment, the compartment comprising an icemaker and an ice storage area;

a secondary cooling path in thermal contact with the icemaker and a heat exchanger disposed within the freezer compartment, the secondary cooling path comprising a liquid coolant, wherein the liquid coolant removes heat from the icemaker via thermal contact, and wherein the heat exchanger removes heat from the liquid coolant; and a venting conduit connected to the secondary cooling path downstream of the heat exchanger wherein the venting conduit has a first end disposed within the freezer compartment and a second end exposed to an atmosphere.

2. The refrigerator of claim 1, wherein the compartment positioned remotely from the freezer compartment is positioned within the fresh food compartment door and wherein the liquid coolant fluidly moves within the secondary cooling path to remove heat from the icemaker via thermal contact and also release heat to the heat exchanger.

3. The refrigerator of claim 2 further comprising a pump, wherein the pump is positioned outside of freezer compartment and along the secondary cooling path for pumping the liquid coolant through the secondary cooling path to drive a fluid movement of the liquid coolant within the secondary cooling path.

4. The refrigerator of claim 1, wherein the ice storage area is an ice bin and wherein the refrigerator further comprises a pump positioned outside of the freezer compartment and along the secondary cooling path in fluid connection with the liquid coolant to drive flow of the liquid coolant.

5. The refrigerator of claim 4, wherein the compartment positioned remotely from the freezer compartment is positioned within the fresh food compartment door.

6. The refrigerator of claim 3, wherein a standby power source is operably connected to the pump and causing the pump to be operable when a power outage occurs to the refrigerator.

7. The refrigerator of claim 6, wherein the ice storage area is an ice bin and the heat exchanger is an evaporator and wherein the liquid coolant cools the icemaker and the ice bin.

8. The refrigerator of claim 7 further comprising a hot liquid defrost system having a three way valve upstream of the pump and downstream from the heat exchanger that switches between allowing the coolant to flow through the secondary cooling path and allowing a hot liquid to flow through the secondary cooling path.

9. The refrigerator of claim 1 further comprising a hot liquid defrost system having a three way valve upstream of a pump and downstream from the heat exchanger that switches between allowing the coolant to flow through the secondary cooling path and allowing a hot liquid to flow through the secondary cooling path.

10. The refrigerator of claim 7, wherein the icemaker is a defrost device and is at a lower temperature than the ice storage area to thereby attract moisture to the icemaker and reduce frost within the ice storage area.

11. The refrigerator of claim 10, wherein the compartment further comprises a fan that, when on, circulates cold air from the icemaker into the ice storage area and the compartment is positioned within the fresh food compartment door.

12. The refrigerator of claim 1, wherein the venting conduit is a tube that is vertically oriented relative to the secondary cooling path at a location where the venting conduit is connected to the secondary cooling path.

13. An appliance comprising:

a cabinet comprising a fresh food compartment and a freezer compartment, the fresh food compartment having a fresh food compartment door;

a compartment positioned outside of the freezer compartment, the compartment comprising an icemaker and an ice storage area;

a secondary cooling path in thermal contact with the icemaker and a heat exchanger disposed within the freezer compartment, the secondary cooling path comprising liquid coolant, wherein the liquid coolant removes heat from the icemaker via thermal contact, and wherein the heat exchanger removes heat from the liquid coolant; and a venting conduit connected to the secondary cooling path downstream of the heat exchanger disposed within the freezer compartment wherein the venting conduit has a first end disposed within the freezer compartment and a second end exposed to an atmosphere.

14. The appliance of claim 13, wherein the compartment further comprises a fan that, when on, circulates cold air from the icemaker into the ice storage area and the compartment is positioned within the fresh food compartment door.

15. The appliance of claim 13, further comprising a pump, wherein the pump is positioned outside of freezer compartment and along the secondary cooling path for pumping the liquid coolant through the secondary cooling path.

16. The appliance of claim 15, wherein the venting conduit is upstream of the pump.

17. An appliance comprising:

a refrigerator cabinet comprising a fresh food compartment and a freezer compartment;

a fresh food compartment door for providing access to the fresh food compartment;

a compartment positioned remotely from the freezer compartment, the compartment comprising an icemaker;

a secondary cooling path in thermal contact with the icemaker and a heat exchanger disposed within the freezer compartment, the secondary cooling path comprising liquid coolant configured to flow within the secondary cooling path such that the liquid coolant removes heat from the icemaker via thermal contact and the heat exchanger removes heat from the liquid coolant; and a venting conduit connected to the secondary cooling path and downstream of the heat exchanger disposed within the freezer compartment wherein the venting conduit has a first end disposed within the freezer compartment and a second end exposed to an atmosphere.

18. The appliance of claim 17, wherein the compartment is an ice compartment that comprises the icemaker and an ice bin and wherein the compartment further comprises a fan that, when on, circulates cold air from the icemaker into the ice bin and the compartment is positioned within the fresh food compartment door.

19. The appliance of claim 17 further comprising a pump positioned outside of freezer compartment and along the secondary cooling path for pumping the liquid coolant through the secondary cooling path.

20. The appliance of claim 19, wherein the venting conduit is upstream of the pump.

* * * * *